United States Patent [19]

Derbyshire

[11] 4,157,836

[45] Jun. 12, 1979

[54] KEYS FOR MANUALLY OPERATED WORK-HOLDING CHUCKS

[75] Inventor: George C. Derbyshire, Sheffield, England

[73] Assignee: Chicago Pneumatic Tool Company, New York, N.Y.

[21] Appl. No.: 884,365

[22] Filed: Mar. 7, 1978

[30] Foreign Application Priority Data

Mar. 8, 1977 [GB] United Kingdom ..... 9777/77

[51] Int. Cl.[2] ..... B25B 13/44

[52] U.S. Cl. ..... 279/1 K; 81/90 A

[58] Field of Search ..... 279/1 K; 81/90 A; 408/241 R, 710

[56] References Cited

U.S. PATENT DOCUMENTS

| | | | |
|---|---|---|---|
| 2,388,414 | 11/1945 | Jernigan | 81/90 A |
| 2,467,827 | 4/1949 | Hinton | 81/90 A |
| 2,629,414 | 2/1953 | Stoner et al. | 279/1 K |
| 2,660,081 | 11/1953 | Dossie | 279/1 K |
| 3,673,895 | 7/1972 | Des Jardins | 81/90 A |
| 3,686,985 | 8/1972 | Ostrager | 81/90 A |
| 3,787,137 | 1/1974 | Renner | 408/241 R |
| 3,869,943 | 3/1975 | Buck | 81/90 A |
| 3,977,686 | 8/1976 | Buck | 279/1 K |
| 4,068,978 | 1/1978 | Brock | 279/1 K |

FOREIGN PATENT DOCUMENTS

| | | | |
|---|---|---|---|
| 825974 | 5/1957 | United Kingdom | 81/90 A |

*Primary Examiner*—Horace M. Culver

[57] ABSTRACT

A key for a drill chuck, the key having resilient means whereby it is ejected automatically from the chuck, and a spindle formed for rotatable support of the resilient means.

2 Claims, 3 Drawing Figures

KEYS FOR MANUALLY OPERATED WORK-HOLDING CHUCKS

BACKGROUND OF THE INVENTION

The invention relates to keys for manually operated work-holding chucks, sometimes referred to as lathe chucks.

The jaws of a lathe chuck are usually adjusted, either in turn or simultaneously, by means of a key having a spindle with a square end which can be plugged into one of a number of adjusting screws flush with or recessed into the periphery of the chuck body. The user of the key will generally apply the required torque to the adjusting screw, or to each adjusting screw in turn, with the key in an upstanding or generally upstanding position and although he will usually remove the key from the chuck as soon as he has either slackened or tightened an adjusting screw or screws there is the danger that the key can sometimes by inadvertence be left in position on the chuck. If the machine is then restarted, the key will be thrown outwards from the chuck by centrifugal force. This is, of course, a very serious hazard. A further and equally dangerous hazard is that an operator can trap his hand between the key and the machine bed if he starts up his machine whilst still holding the key in engagement with one of the adjusting screws.

According to the invention, there is provided a key for a work-holding chuck, the key having resilient means whereby it is ejected automatically from the chuck when released by the user, the resilient means being constituted by a spring steel plate member having a central hole through which a spindle part of the key freely extends and having finger elements which are deflected as the driving end of the spindle is plugged into an adjusting screw of a work-holding chuck, the spindle part of the key being provided with a loosely fitted sleeve so that a user of the key can grasp the sleeve in one hand and spin the key with his other hand. The spring steel plate member may abut against an end of said sleeve and be retained in abutment with the end of the sleeve by a circlip engaging a groove in the spindle part, and an end of the sleeve remote from the spring steel plate member may abut against a washer which in turn abuts against a circlip engaging a groove in the spindle. On the other hand, the spring steel plate may be located between a pair of circlips. A tommy bar which is provided for imparting a torque to the key may be fixed to the spindle part or may be slidably located in a hole in the spindle part through which it extends.

BRIEF DESCRIPTION OF THE DRAWINGS

In order that the invention may be fully understood and readily carried into effect, the same will now be described, by way of example only, with reference to the accompanying drawings, of which:

Referring now to FIGS. 1 and 2 of the drawings, the lathe chuck key there illustrated includes a spindle 10 with a square end 12 which can be plugged into any one of the usual adjusting screws with which a lathe chuck is provided, At its other end the spindle is provided with a tommy bar 14 by which torque can be imparted to the key when the square end has been plugged into an adjusting screw.

Figure 1:
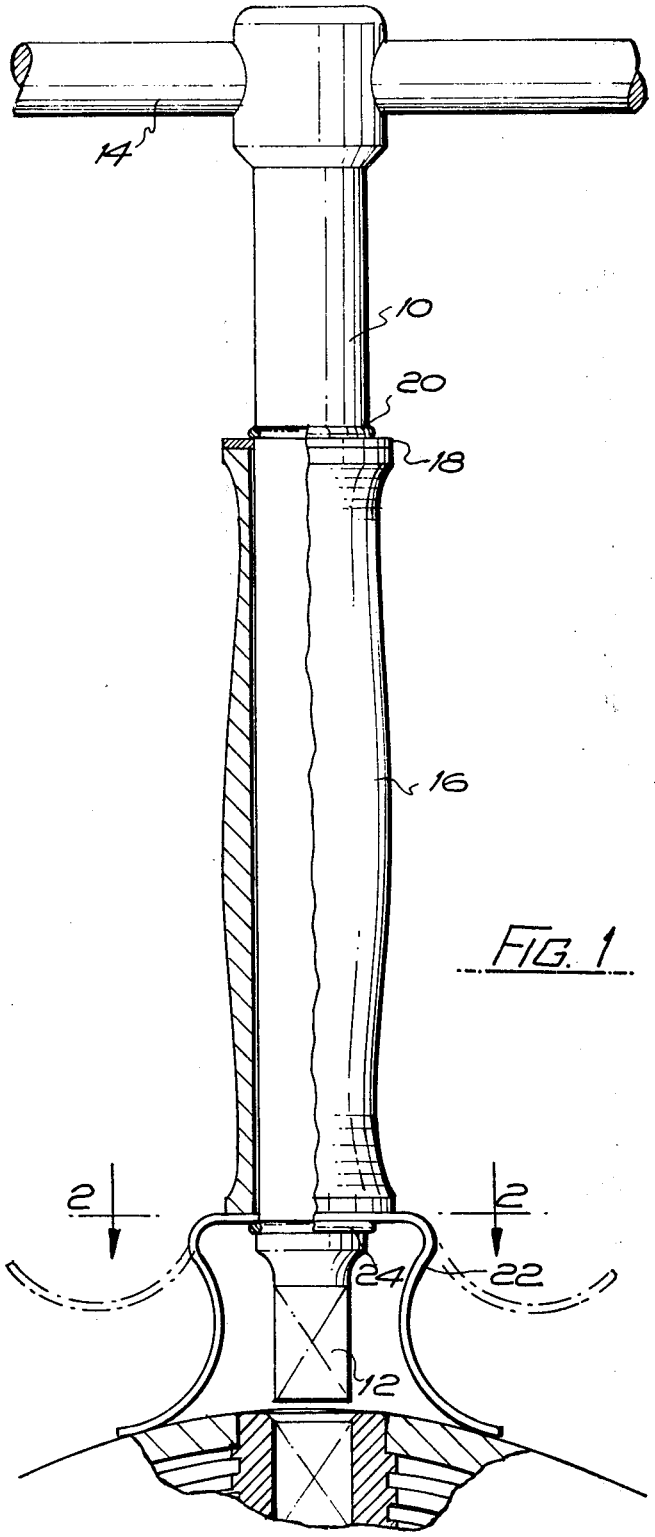
FIG. 1 is a part-sectional side view of a lathe chuck key embodying the invention.
Figure 2:
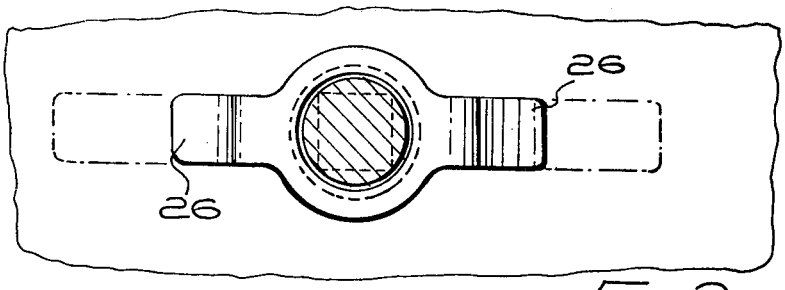
FIG. 2 is a sectional view on the line 2—2 in FIG. 1.

Intermediate its ends the spindle is provided with a loosely fitted sleeve 16 which constitutes a hand grip for the user. One end of said sleeve abuts against a washer 18 which in turn abuts against a circlip 20 engaging a groove in the spindle. The other end of the sleeve abuts against a spring steel plate member 22 through a central hole in which the spindle extends. The plate member is retained in abutment with the end of the sleeve by a circlip 24 which engages a further groove in the spindle.

The spring steel plate member consitutes resilient means whereby the key is ejected automatically from the chuck when released by the user, the spring plate member being provided with oppositely disposed finger elements 26 which are deflected, when the square end of the spindle is plugged into an adjusting screw of a lathe chuck, the finger elements bearing against the curved periphery of the chuck as shown and moving outwardly as shown in chain-dotted lines as the square end of the key is plugged into one of the adjusting screws of the chuck.

Figure 3:
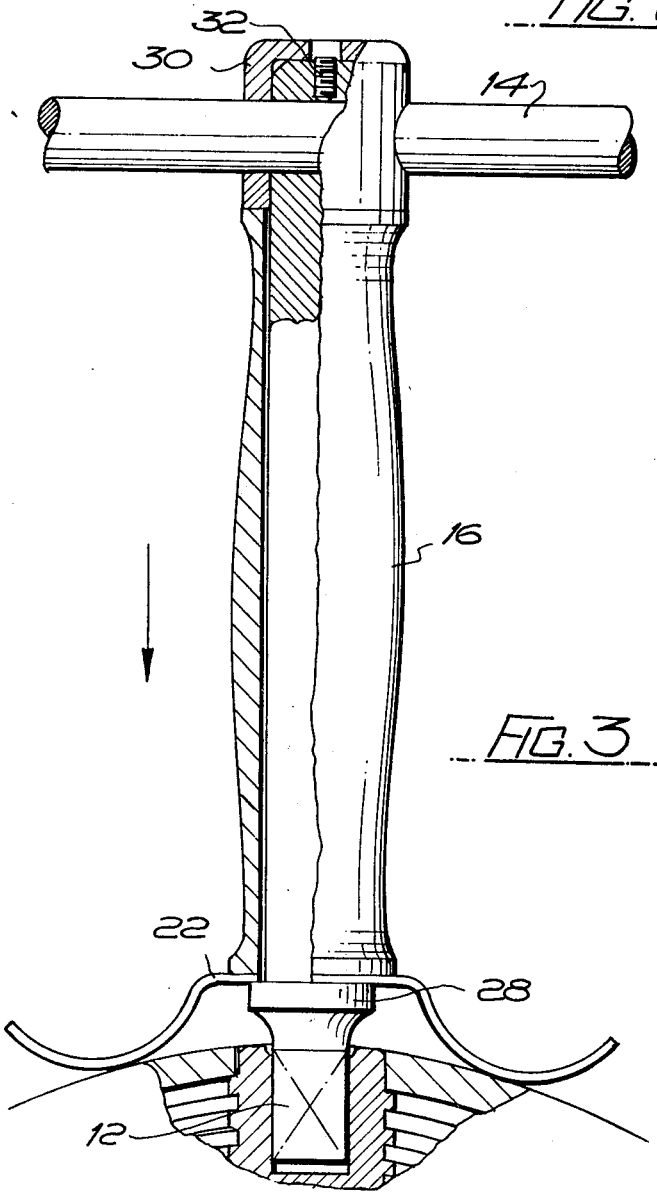
FIG. 3 is a view very similar to FIG. 1 of another form of lathe chuck key embodying the invention.

In FIG. 3, there is illustrated a slightly different form of lathe key embodying the invention. In this key, since it is somewhat smaller than that illustrated in FIG. 1, the sleeve 16 occupies the entire length of the spindle. In addition, it will be seen that the plate member 22 abuts against the annular flange 28 which has been formed on the spindle adjacent its square end 12, and the upper end of the sleeve abuts against a cap member 30 which is retained in position by the tommy bar 14 which extends through oppositely located holes in the cap member and through a hole extending diametrically through the spindle. The tommy bar is located in position by a screw 32. The plate member 22 is in this case shown in its deflected condition, the square end 12 having been plunged into one of the usual adjusting screws of the chuck with which the key is shown to be associated.

Thus there is provided a key for a lathe chuck which cannot by inadvertence be left in position on a chuck. When released by the user, the key immediately ejects itself from the chuck. Consequently, there is no danger of the key being thrown outwards by centrifugal force, and there is less likelihood of an operator starting his machine whilst still holding the key in engagement with an adjusting screw with only one hand. The presence of the loosely fitted sleeve 16 is advantageous because the user can grip the sleeve in one hand and spin the key with his other hand to effect rapid adjustment of the chuck jaws. It will be understood, however, that the sleeve need not necessarily be of the form illustrated in the drawings. For example, it can be machined from wood or metal, or die cast or moulded from plastics materials. Its shape can be varied to suit the size of key within the required range of keys suitable for small and large work-holding chucks. The tommy bar 14 may be fixed to the spindle or, if preferred, may be slidably located in the hole through which it extends.

Various other modifications may be made without departing from the scope of the invention. For example, although the resilient means for ejecting the key automatically when it has been used have been referred to as being made from spring steel plate in the examples described, it is quite possible for the resilient means to be made of a suitable synthetic plastics material or of a non-ferrous metal if safety from sparking is required or where an anti-rust application is required.

I claim:

1. A self-ejecting key for use on a work holding chuck said key comprising a spindle having a square portion at one end for engagement with an adjusting screw of the chuck the other end being formed to receive a cross bar for manual rotation of the spindle, a spring steel plate member mounted upon the spindle adjacent the square portion, said plate member having splayed finger elements which are resiliently flexed by contact with the chuck when the key is in operative engagement with an adjusting screw of the chuck, and a loosely fitted sleeve arranged upon the spindle between the square portion and the other end of the spindle.

2. A self-ejecting key according to claim 1, wherein the extremities of said finger elements project beyond the end of the spindle square portion when the key is not applied to a chuck adjusting screw.

* * * * *